United States Patent [19]

Gurley

[11] 4,083,547

[45] Apr. 11, 1978

[54] VISE

[76] Inventor: Grey M. Gurley, 900 Tioga Dr., Apt. 204, Ventura, Calif. 93001

[21] Appl. No.: 812,151

[22] Filed: Jul. 1, 1977

[51] Int. Cl.[2] ..... B25B 1/20

[52] U.S. Cl. ..... 269/156; 269/239; 269/279

[58] Field of Search ..... 269/156, 258, 268, 279, 269/280, 237, 239, 226

[56] References Cited

U.S. PATENT DOCUMENTS

| | | | |
|---|---|---|---|
| 225,000 | 3/1889 | Dickson | 269/226 |
| 1,515,286 | 11/1924 | Svebilius | 269/239 |
| 1,586,314 | 5/1926 | Kiefer | 269/258 |
| 1,761,366 | 6/1930 | Reutter | 269/287 |
| 2,422,773 | 6/1947 | Colwill | 269/156 |
| 2,610,661 | 9/1952 | Romine | 269/156 |
| 2,634,639 | 4/1953 | Sowell | 269/239 |

*Primary Examiner*—Robert C. Watson
*Attorney, Agent, or Firm*—Poms, Smith, Lande & Glenny

[57] ABSTRACT

A vise which is constructed of three jaws which are movable to be clamped upon an exterior object, two of the jaws moving in synchronism in respect to another jaw located in a specific position. The movable jaw assemblies are located in an overlapping crossed arrangement. The configuration of the jaws can be altered to grasp not only objects of regular shape, but also objects of irregular shape.

15 Claims, 10 Drawing Figures

VISE

BACKGROUND OF THE INVENTION

The field of this invention relates to clamping devices and more particularly to a new and novel vise which can be employed to grasp practically any configuration of exterior object in practically any orientation.

The conventional type of bench vise employs two jaws with each jaw having a planar gripping surface. This type of a vise clamps very securely upon planar objects, such as for example, a sheet of metal, a polygonal shaped iron bar, etc. However, not all devices include planar surfaces in order to be readily grasped by a conventional two-jawed vise. It is practically impossible to grip a sphere in a two-jaw vise without having the sphere turn when performing operations on the sphere. The same problem occurs when gripping cylindrical shaped objects. Additionally, if the object is of irregular shape, the gripping of such an object by a conventional two-jaw vise may be extremely difficult.

SUMMARY OF THE INVENTION

The vise of this invention includes a mounting base within which is located an enlarged opening. The mounting base is provided with attachment structure to facilitate securing of the vise to a fixed object, such as a bench. Pivotally mounted on the base is a first jaw. Also pivotally mounted on the base are second and third jaw assemblies. The second and third jaw assemblies include second and third jaws which are pivotally mounted upon the free end of an elongated member. The elongated member of the second and third jaws are crossed in an overlapping arrangement. Means is provided to move the second and third jaw assemblies in respect to the base simultaneously and synchronously toward and away from the first jaw. Therefore, with an exterior object located between the three in number of jaws, the exterior object is to be firmly held by movement of the movable jaws into tight contact with the exterior object. The exterior object may extend within or through the enlarged opening within the base if additional access space is required. Each of the jaws are pivotally mounted and each jaw includes a plurality of different sides. Each side of each jaw is configured differently in order to facilitate clamping a specific configuration of object. The jaws can also be replaced with different configuration of jaws to accommodate a still far greater variety of shapes of objects to be held.

The primary objective of this invention is to provide for a vise which will securely grip a wide variety of odd shaped objects as well as regular shaped objects.

A further object of this invention is to provide a simple means of quickly opening and closing the jaws of the vise and also a simple means of effecting tight securement of the vise when an object is gripped.

DETAILED DESCRIPTION OF THE SHOWN EMBODIMENT

Figure 1:
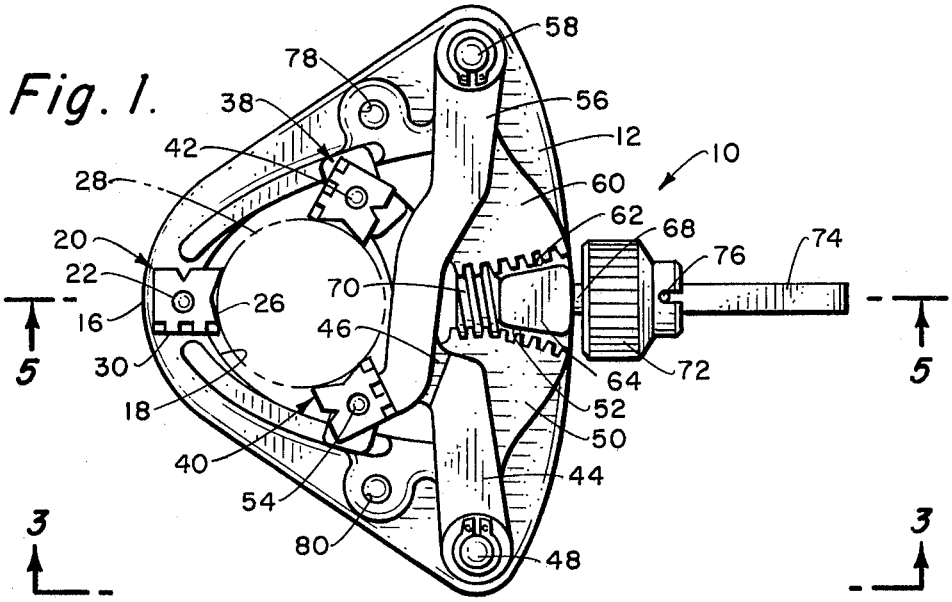
FIG. 1 is a plan view of the vise of this invention depicting gripping an enlarged regular shaped object, such as a cylinder of sphere.

Referring particularly to the drawings, there is shown the vise 10 of this invention which includes as its main component a base 12. The base 12 is to be constructed of a rigid material, in most instances of metal, such as steel or aluminum.

The base 12 includes an upstanding post 14 which is located adjacent the front end 16 of the base 12. Located within the base 12 is an enlarged opening 18, the function of which will be described further on in the specification.

Figure 2:
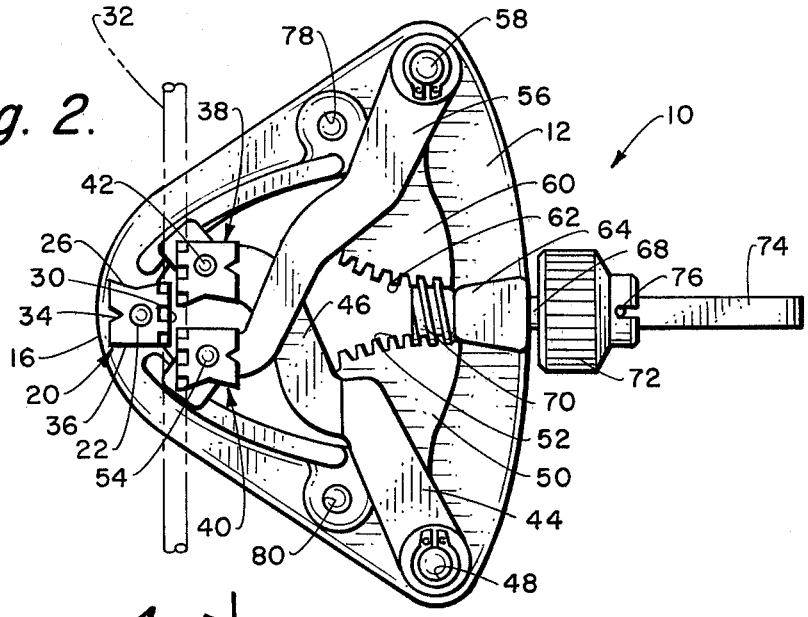
FIG. 2 is a view similar to FIG. 1 but showing the vise gripping an elongated thin rod.
Figure 3:
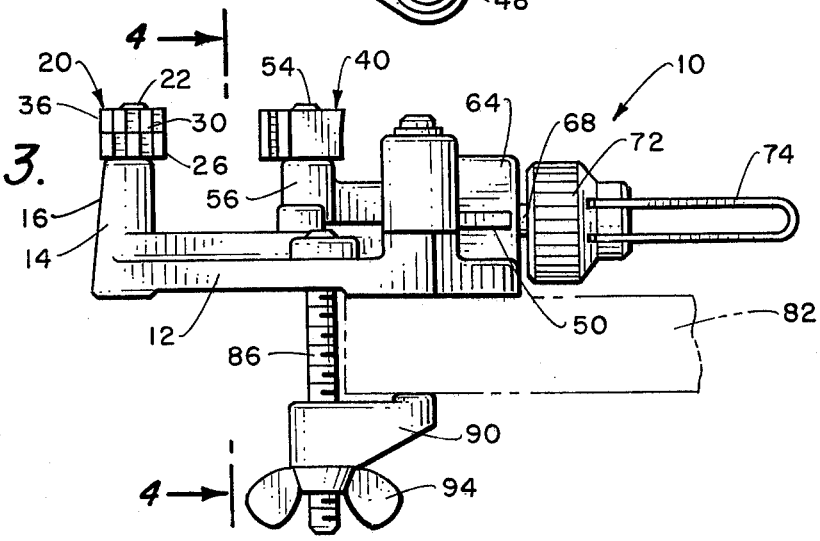
FIG. 3 is an end view of the vise of this invention taken along line 3—3 of FIG. 1.
Figure 4:
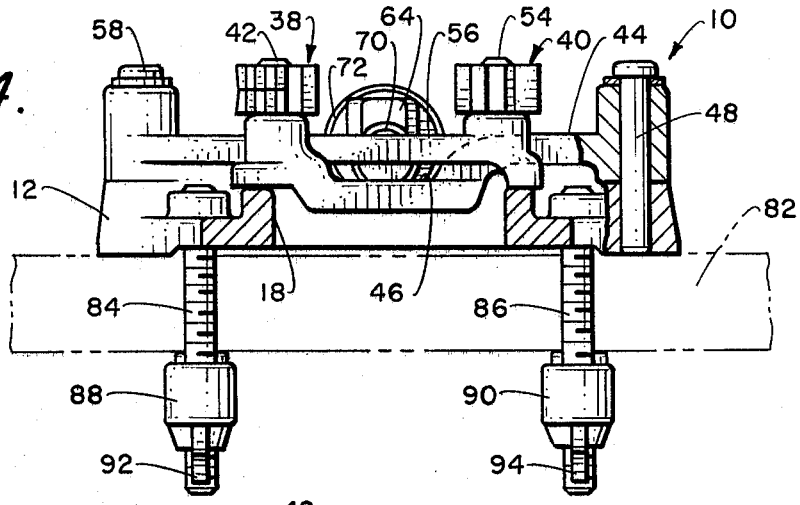
FIG. 4 is a partial cross-sectional view of the vise of this invention taken along line 4—4 of FIG. 3.

A first jaw 20 is pivotally mounted upon a pivot pin 22 which, in turn, is either pivotally mounted or secured within an opening 24 provided in the upstanding post 14. The jaw 20 may be rotated to different angular positions upon the pin 22. The jaw 20 is shown to have four separate sides and assume a basic square configuration. However, it is to be understood that any particular configuration could be employed, either polygonal shaped having more or less sides, or shapes such as cylindrical, elliptical or even an irregular shape, if desired. The purpose of having four separate sides upon the jaw 20 is so that each side of the jaw is designed in particular to accommodate a particularly shaped object. Side 26 is designed in particular to accommodate surfaces of revolution, such as a cylinder or a sphere depicted in phantom lines as numeral 28 within FIG. 1. Side 30 is designed in particular to accommodate an elongated rod, such as shown in phantom lines as numeral 32 in FIG. 2. Side 34 is designed in particular to accommodate a rod (not shown) which is located in a ninety degree position from the rod 32. Side 36 is designed in particular to accommodate a planar shaped object. Therefore, it can be seen that merely by pivoting of the jaw 20, the most desirable side which will facilitate tight gripping of an object can be employed.

A second jaw 38 and a third jaw 40 are employed which are essentially an exact duplicate of the jaw 20. Therefore, it is to be understood that the previous numerals as well as the previous discussion are also applicable to the jaws 38 and 40.

Jaw 38 is pivotally mounted by means of a pivot pin 42 on a member 44. Member 44 includes a recessed section 46. The purpose of the recessed section 46 will be explained further on in the specification.

The free end of the member 44 is attached by means of a pivot pin 48 to one side of the base 12. An extension 50 is integrally formed upon the member 44. The extension 50 includes a series of gear teeth 52.

The jaw 40 is pivotally mounted by means of pin 54 on a member 56. The member 56 passes through the recess 46 so that the members 56 and 44 overlap each other in a crossed arrangement. The reason for this is to accommodate the unique movement of the movable jaws 38 and 40 of the vise of this invention.

The member 56 is pivotally mounted by means of a pivot pin 58 to the base 12. The member 56 also includes an extension 60 which includes a series of gear teeth 62.

Secured to the base 12, substantially at the mid point between the pivot pins 58 and 48 is an upstanding anvil 64. Extending through an opening 66 within the anvil 64 is a shaft 68. The forwardmost end of the shaft 68 is attached to a worm gear 70. The worm gear 70 operatively engages the gear teeth 62 and 52.

Figure 5:
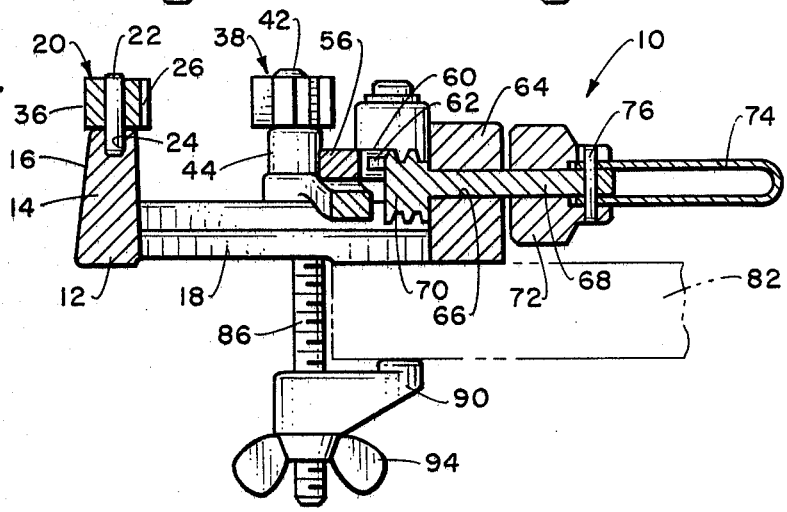
FIG. 5 is a side cross-sectional view taken along line 5—5 of FIG. 1.
Figure 6:
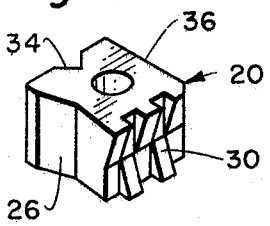
FIG. 6 is an isometric view of the primary embodiment of gripping jaw employed within the vise of this invention.
Figure 7:
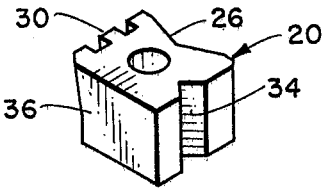
FIG. 7 is an isometric view of the jaw of FIG. 6 but taken from the rear direction.

The aft end of the shaft 68 is secured to a knob 72. The exterior surface of the knob 72 is knurled so as to facilitate manual turning thereof. A lever 74 is pivotally mounted by means of pin 76 to the knob 72. The lever 74 can be pivoted ninety degrees from the position shown in FIGS. 1, 2 and 5 so as to facilitate the applying of additional torque to the shaft 68 to more tightly secure the grip on the object held within the vise.

Each operation of the vise of this invention is as follows: The shaft 68 is rotated by knob 72 in a clockwise direction which results in the jaws 40 and 38 being located somewhat in a position depicted in FIG. 1. The object to be held within the vise is positioned in between the jaws 38 and 40 and 20 and the object may extend within the enlarged opening 18 if additional access area is required. With the object to be held so positioned, the operator then proceeds to turn the knob 72 in the counterclockwise direction which causes the worm gear 70 to operate against the extensions 50 and 60 and pivot the members 44 and 56 simultaneously. This results in the jaws 38 and 40 being moved against the object to be held. The object is then clamped with three points of contact by the jaws 38 and 40 and jaw 20. In order to further insure tight gripping of the object, the operator can pivot the lever 74 to a position ninety degrees displaced from what is shown in the drawings and use the lever 74 to apply further torque to the shaft 68.

It is to be understood that in order to release the grip of the jaws against the gripped object, it is only necessary to rotate the shaft in the opposite direction.

If it is desired, as in most cases it is, to permanently affix the vise 10 of this invention to a bench or other similar object, the securement can be accomplished either by placing of conventional fasteners through holes 78 and 80 and into a bench 82, or the securement can be accomplished by means of a conventional clamping arrangement which takes the form of threaded fasteners 84 and 86 which extend through the openings 78 and 80 and each of the threaded fasteners 84 and 86 cooperating respectively with a clamp member 88 and 90. A wing nut 92 connects with the threaded member 84 and is located against the clamping member 88. A wing nut 94 is threadably connected with threaded fastener 86 and operates against the clamping member 90. By tightening of the wing nuts 92 and 94 the clamping members 88 and 90 can abuttingly contact in a secure manner the underside of the bench 82 and thereby firmly secure the vise 10 of this invention to the bench 82.

Figure 8:
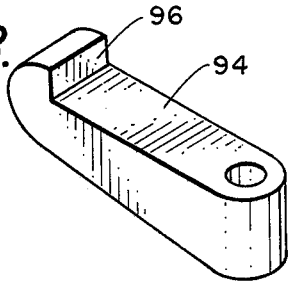
FIG. 8 is an isometric view of a second embodiment of gripping jaw that could be employed in conjunction with the vise of this invention.
Figure 9:
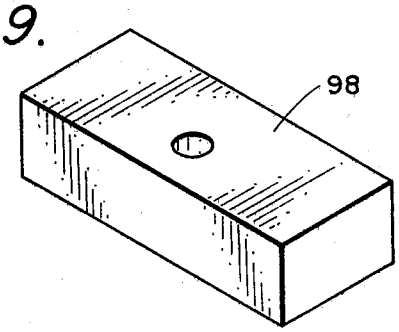
FIG. 9 is an isometric view of a third embodiment of gripping jaw that could be employed in conjunction with the vise of this invention.
Figure 10:
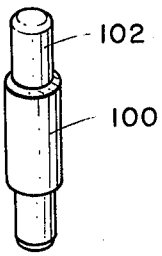
FIG. 10 is an isometric view of an extender which could be employed in conjunction with any one of the embodiments of gripping jaws in order to raise the jaw a spaced distance above the base of the vise.

To increase the versatility of the vise 10 of this invention, the jaws 20, 38 and 40 could be removed and replaced with other types of jaws such as shown in FIGS. 8 and 9. Within FIG. 8, the jaw 94 comprises an elongated member which includes an upstanding flange 96. The jaw shown in FIG. 8 would be particularly adaptable to clamping onto flat plates where the surface of the flat plate is located substantially parallel to the upper surface of the base 12.

Within FIG. 9, an essentially rectangular block type of member 98 is shown which could also be substituted for the jaws and the member 98 would be particularly adapted to clamping onto flat plates wherein the surface of the plate is located perpendicular to the upper surface of the base 12.

If the vise 10 is to be employed to grasp enlarged objects, it may be desirable to raise or space the jaws further from the base 12. An extension 100 is to be employed. The extension 100 is to merely replace each of the pivot pins 22, 42 and 54. The particular selected type of jaw is then placed upon the smaller diametered section 102 of each pin 100 and the vise is then used in the normal manner.

I clam:

1. A vise comprising:

a base;

a first jaw mounted to remain substantially fixed in a specific position upon said base;

a second jaw assembly movably mounted upon said base;

a third jaw assembly movably mounted upon said base;

means for simultaneously moving the jaws of said second and third jaw assemblies toward said first jaw along paths which are spaced from and which substantially form an acute angle with one another over the greater portion of the holding range of said jaws, to thereby clamp an exterior object between said first jaw and the jaws of said second and third jaw assemblies; and said second and third jaw assemblies overlapping each other in a crossed configuration.

2. The vise as defined in claim 1 wherein:

said first jaw is pivotally mounted upon said base, said first jaw having at least three sides with each side being of a different configuration thereby permitting said first jaw to be pivoted to place a particularly configurated side in contact with the object to be clamped.

3. The vise as defined in claim 2 wherein:

said second jaw assembly includes a second jaw, said third jaw assembly including a third jaw, both said second jaw and said third jaw being pivotally mounted in respect to its respective said assembly, both said second jaw and said third jaw including multiple sides with each side being of a different configuration, whereby a particular configurated side may be employed to facilitate clamping to a particular configuration of an exterior object.

4. The vise as defined in claim 1 wherein:

means are provided for pivotally mounting said second jaw assembly and said third jaw assembly at opposite sides of said base to position said second and third jaws to substantially form with said first jaw the apeces of an equilateral triangle substantially throughout the operating range of the vise.

5. The vise as defined in claim 4 wherein:

said first jaw and said second jaw and said third jaw are each replaceable with different jaw configuration.

6. The vise as defined in claim 1 wherein:

said base includes an enlarged opening, whereby an exterior object may be placed between said jaws and is capable of extending into and through said opening.

7. The vise as defined in claim 1 wherein:

said means for moving said second and third jaw assemblies comprises a worm gear assembly.

8. The vise as defined in claim 1 wherein:

said first jaw is rotatably mounted upon said base, said first jaw having multiple sides with each side being of a different configuration thereby permitting said first jaw to be rotated to place a particularly configurated side in contact with the object to be clamped.

9. The vise as defined in claim 1 wherein:

both said second jaw assembly and said third jaw assembly are pivotally mounted upon said base, at opposite sides of said base.

10. The vise as defined in claim 1 wherein:

said second jaw assembly includes a second jaw, said third jaw assembly includes a third jaw, said first jaw and said second jaw and said third jaw each being replaceable with different jaw configurations.

11. A vise as defined in claim 1 wherein said acute angle is approximately equal to sixty degrees.

12. A vise as defined in claim 1 wherein means are provided for pivotally mounting said second and third jaw assemblies at opposite sides of said base and for synchronizing their movement to provide substantially equal spacing between said three jaws throughout the operating range of said vise.

13. A vise comprising:

a base;

a first jaw mounted to remain substantially fixed in a specific position upon said base;

a second jaw assembly movably mounted upon said base;

a third jaw assembly movably mounted upon said base;

means for simultaneously moving the jaws of said second and third jaw assemblies toward said first jaw along paths which are spaced from and which substantially form an acute angle with one another over the greater portion of the holding range of said jaws, to thereby clamp an exterior object between said first jaw and the jaws of said second and third jaw assemblies; and said second jaw assembly including a second jaw, said third jaw assembly including a third jaw, both said second jaw and said third jaw being pivotally mounted in respect to its respective said assembly, both said second jaw and said third jaw including at least three sides with each side being of a different configuration, whereby a particular configurated side may be employed to facilitate clamping to a particular configuration of an exterior object; and wherein each of said three jaws includes means for presenting an angled work gripping surface having at least two planes perpendicular to the plane extending through said three jaws, and each of said three jaws also includes means for presenting another angled work-gripping surface having at least two angled planes having a line of intersection extending substantially parallel to the plane extending through said three jaws, whereby elongated objects of circular configuration may be firmly held in orientations perpendicular to or parallel to the plane extending through said three jaws.

14. The vise as defined in claim 13 wherein:

said base includes an enlarged opening, whereby an exterior object may be placed between said jaws and is capable of extending into and through said opening.

15. The vise as defined in claim 13 wherein:

said means for moving said second and third jaw assemblies comprises a worm gear assembly.

* * * * *